US007309147B2

(12) United States Patent
Martin

(10) Patent No.: US 7,309,147 B2
(45) Date of Patent: Dec. 18, 2007

(54) FLASHLIGHT

(75) Inventor: Richard W. Martin, San Antonio, TX (US)

(73) Assignee: Lightstick Partners, LLC, San Antonio, TX (US)

( * ) Notice: Subject to any disclaimer, the term of this patent is extended or adjusted under 35 U.S.C. 154(b) by 149 days.

(21) Appl. No.: 11/257,612

(22) Filed: Oct. 25, 2005

(65) Prior Publication Data

US 2006/0109655 A1 May 25, 2006

Related U.S. Application Data

(60) Provisional application No. 60/630,455, filed on Nov. 23, 2004.

(51) Int. Cl.
*F21V 29/00* (2006.01)

(52) U.S. Cl. ..... 362/294; 362/102; 362/190; 362/191; 362/396

(58) Field of Classification Search ..... 362/102, 362/190, 191, 294, 396
See application file for complete search history.

(56) References Cited

U.S. PATENT DOCUMENTS 5,143,465 A * 9/1992 Hou ..... 401/195
5,647,591 A * 7/1997 Parsons ..... 463/47.4
6,511,203 B1 * 1/2003 Winther ..... 362/202
6,921,181 B2 * 7/2005 Yen ..... 362/206
2004/0130892 A1 * 7/2004 Galli ..... 362/187
2004/0190286 A1 * 9/2004 Chapman ..... 362/171

* cited by examiner

*Primary Examiner*—Stephen F. Husar
*Assistant Examiner*—Meghan K. Dunwiddie
(74) *Attorney, Agent, or Firm*—Christopher L. Makay

(57) ABSTRACT

A flashlight includes a body, a flashlight head assembly, and a switch assembly. The body includes a first end securable to the flashlight head assembly, a second end, and a substantially cylindrical portion between the first end and the second end. The switch assembly, which is located at the substantially cylindrical portion of the body adjacent the second end, electrically connects with the flashlight head assembly to regulate the delivery of power thereto. The flashlight head assembly includes a first end and a second end securable to the body, a lens disposed in the flashlight head at the first end, a reflector disposed in the flashlight head adjacent the lens, a heat sink disposed in the flashlight head adjacent the reflector, and an LED assembly disposed within the heat sink such that the heat sink substantially completely surrounds the LED assembly. The flashlight further includes a clip disposed at the second end of the body and a hitch ball securable to the second end of the body such that the hitch ball fastens the clip to the body. The flashlight may further include a baton securable to the second end of the body.

31 Claims, 9 Drawing Sheets

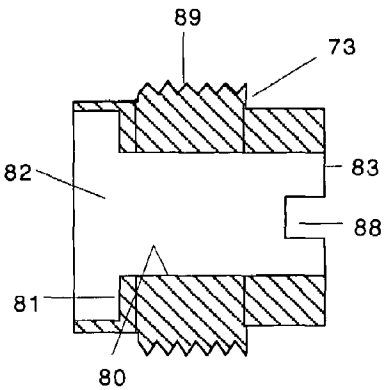
Figure 8
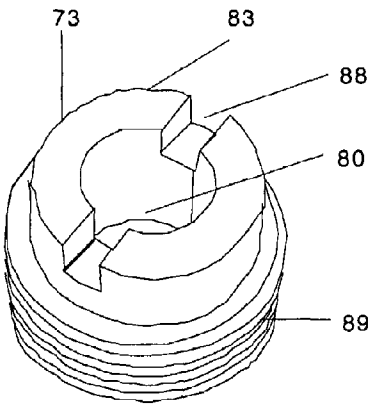
Figure 7
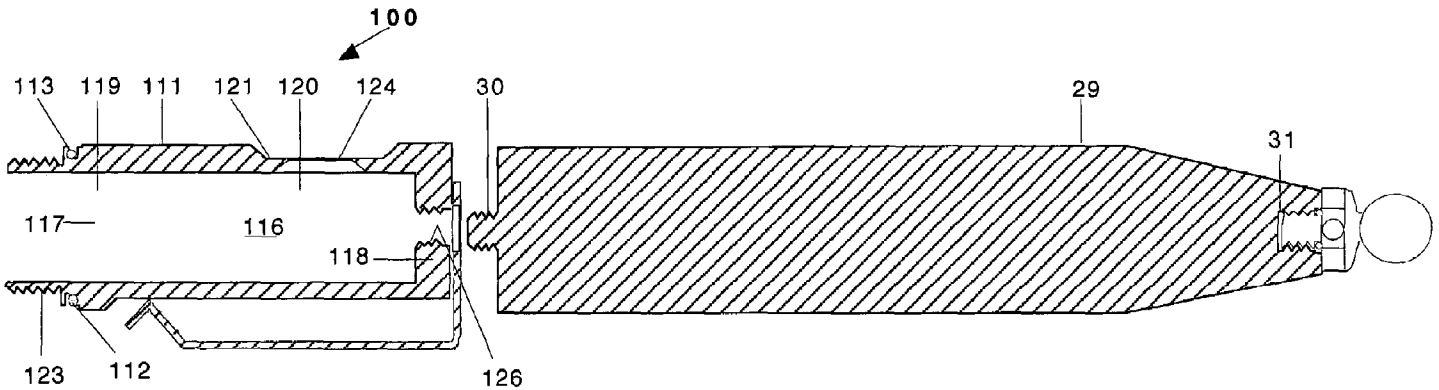
Figure 10
Figure 9

Front View

Back View

Front View

Back View

FLASHLIGHT

CROSS-REFERENCE TO RELATED APPLICATION

This present application claims all available benefit, under 35 U.S.C. § 119(e), of U.S. provisional patent application Ser. No. 60/630,455 filed Nov. 23, 2004. By this reference, the full disclosure of U.S. provisional patent application Ser. No. 60/630,455 is incorporated herein as though now set forth in its entirety.

BACKGROUND OF THE INVENTION

1. Field of the Invention

The present invention relates to flashlights and, more particularly, but not by way of limitation, to a flashlight incorporating light emitting diode (LED) technology.

2. Description of the Related Art

The majority of flashlights currently marketed employ an incandescent bulb to supply the light beam. Incandescent bulbs operate adequately; nevertheless, such bulbs suffer certain disadvantages. Incandescent bulbs are fragile and often break when a flashlight is jarred. Incandescent bulbs further are inefficient in that batteries utilized to supply power are typically drained after less than an hour of continuous use. Incandescent bulbs still further allow leakage from the batteries such that the batteries are drained even when a flashlight is off.

To overcome the aforementioned problems associated with incandescent bulbs, flashlights employing LED technology have been introduced. With proper heat rejection, LED technology flashlights provide light beams comparable to the light beam from an incandescent bulb flashlight. LED technology flashlights however do not suffer the disadvantages of incandescent bulb flashlights. LED technology flashlights are rugged and not prone to break when a flashlight is jarred. LED technology flashlights further provide as much as three times the amount of battery life and do not cause leakage from the batteries. Accordingly, a flashlight employing LED technology that includes improved heat rejection will improve over both existing LED technology flashlights as well as incandescent bulb flashlights.

SUMMARY OF THE INVENTION

In accordance with the present invention, a flashlight includes a body, a flashlight head assembly, and a switch assembly. The body includes a first end securable to the flashlight head assembly, a second end, and a substantially cylindrical portion between the first end and the second end. The flashlight further includes a clip disposed at the second end of the body and a hitch ball securable to the second end of the body such that the hitch ball fastens the clip to the body. The flashlight may further include a baton securable to the second end of the body.

The switch assembly, which is located at the substantially cylindrical portion of the body adjacent the second end, electrically connects with the flashlight head assembly to regulate the delivery of power thereto. The switch assembly includes a switch housing disposed within the body at the second end, a switch mounted to the switch housing such that the switch protrudes through the switch aperture, and a switch cap secured to the body over the switch aperture.

The flashlight head assembly includes a first end and a second end securable to the body, a lens disposed in the flashlight head at the first end, a reflector disposed in the flashlight head adjacent the lens, a heat sink disposed in the flashlight head adjacent the reflector, and an LED assembly disposed within the heat sink such that the heat sink substantially completely surrounds the LED assembly. The heat sink substantially completely surrounds the LED assembly in order to maximize the surface area contact between the heat sink and the LED assembly. The heat sink further substantially completely surrounds the LED assembly in order to maximize the mass of conductive material about the LED assembly. The heat sink engages the flashlight head such that the flashlight head assembly functions as a heat sink for the LED assembly. Similarly, the flashlight head assembly engages the body such that the flashlight functions as a heat sink for the LED assembly. The reflector may be constructed from a thermally conductive material such that, when the heat sink engages the reflector, the reflector functions as a heat sink for the LED assembly.

In one embodiment, the LED assembly includes an LED disposed within a first end of the heat sink, a printed circuit board disposed within a second end of the heat sink, and a micro-electronic circuit disposed on the printed circuit board. The LED electrically connects with the printed circuit board such that the micro-electronic circuit controls the delivery of power to the LED. Moreover, the LED resides at the first end of the heat sink and the printed circuit board resides at the second end of the heat sink in order to thermally isolate the micro-electronic circuit from the LED. The LED assembly further includes an input terminal electrically connected with the printed circuit board and a ground terminal electrically connected with the printed circuit board, wherein the ground terminal engages the heat sink such that the heat sink electrically connects with the LED assembly. Alternatively, the LED further includes an input terminal electrically connected with the printed circuit board and a ground connector electrically connected with the printed circuit board, wherein the ground connector engages the body thereby electrically connecting the LED assembly with the switch assembly.

In another embodiment, the LED assembly includes a printed circuit board disposed within the heat sink, an LED disposed within the heat sink, and a micro-electronic circuit disposed on the printed circuit board. The LED electrically connects with the printed circuit board such that the micro-electronic circuit controls the delivery of power to the LED. The LED may mount on the printed circuit board. The LED assembly further includes an input terminal electrically connected with the printed circuit board and a ground terminal electrically connected with the printed circuit board, wherein the ground terminal engages the heat sink such that the heat sink electrically connects with the LED assembly.

In still another embodiment, the LED assembly includes a housing disposed within the heat sink, an LED disposed within the housing, and a micro-electronic circuit disposed within the housing, wherein the micro-electronic circuit controls the delivery of power to the LED. The housing includes an input terminal electrically connected with the micro-electronic circuit. The housing further electrically connects with the micro-electronic circuit such that, when the housing engages the heat sink, the heat sink electrically connects with the LED assembly.

It is therefore an object of the present invention to provide a flashlight with improved heat rejection through a heat sink that substantially completely surrounds an LED assembly.

It is another object of the present invention to provide a flashlight with a switch assembly located at the rear of the flashlight but not on the rear end of the flashlight.

It is a further object of the present invention to provide a flashlight with a clip and a hitch ball.

Still other objects, features, and advantages of the present invention will become evident to those of ordinary skill in the art in light of the following detailed description.

BRIEF DESCRIPTION OF THE DRAWINGS

FIG. 7 is a perspective view illustrating the heat sink for the first embodiment of the flashlight head assembly.

FIG. 8 is a cross-sectional view illustrating the heat sink for the first embodiment of the flashlight head assembly.

FIG. 9 is a cross-sectional side view illustrating a body for a flashlight according to a second embodiment.

FIG. 10 is a side view illustrating a baton attachable to a flashlight according to either a first or second embodiment.

DETAILED DESCRIPTION OF THE PREFERRED EMBODIMENTS

Figure 1:
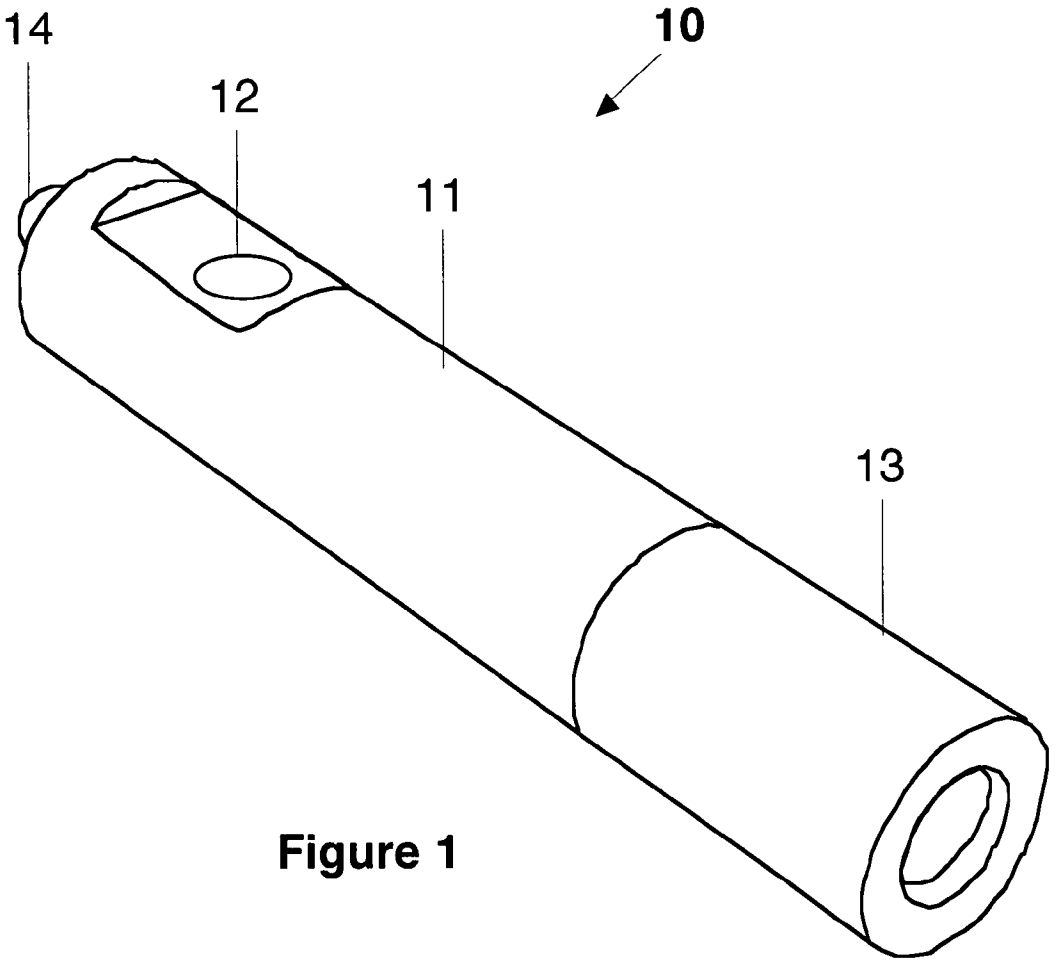
FIG. 1 is a perspective view illustrating a flashlight according to a first embodiment.
Figure 2:
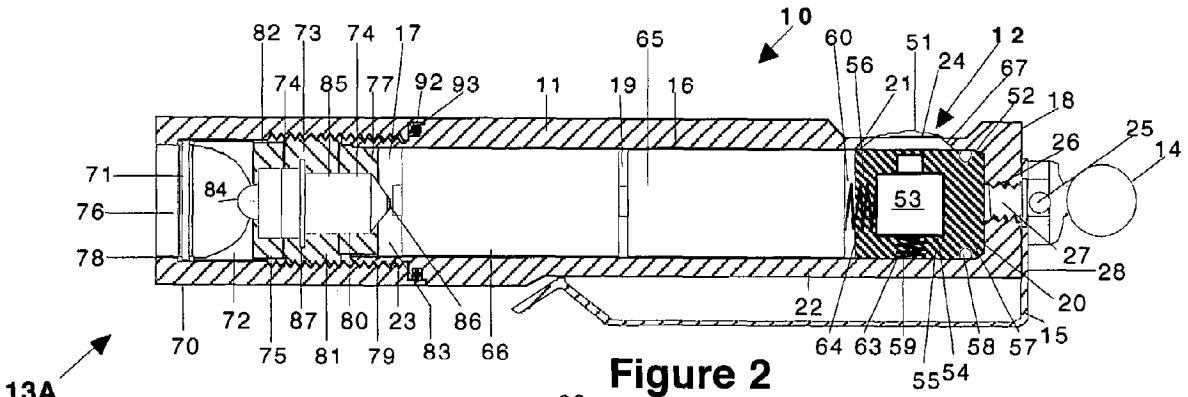
FIG. 2 is a cross-sectional view illustrating the flashlight according to a first embodiment.
Figure 3:
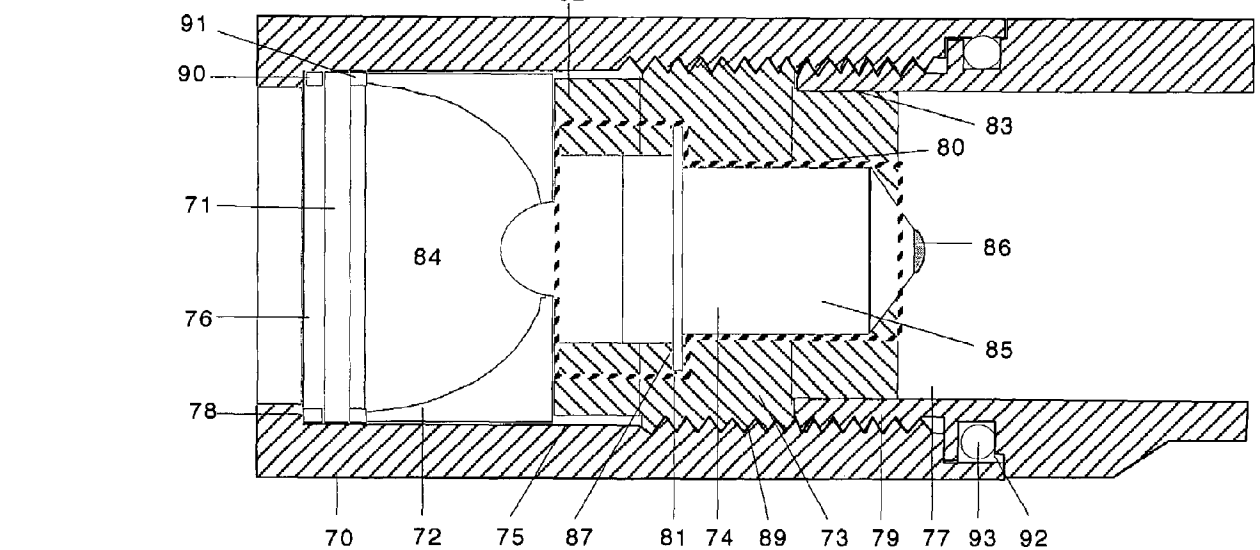
FIG. 3 is a cross-sectional view illustrating a first embodiment of a flashlight head assembly for a flashlight according to either a first or second embodiment.

FIG. 1 illustrates a flashlight 10 according to a first embodiment as including a body 11, a switch assembly 12, and a flashlight head assembly 13, which may be a flashlight head assembly 13A according to a first embodiment, a flashlight head assembly 13B according to a second embodiment, a flashlight head assembly 13C according to a third embodiment, or a flashlight head assembly 13D according to a fourth embodiment. FIG. 2 illustrates the flashlight 10 as further including a hitch ball 14 and a clip 15.

Figure 4:
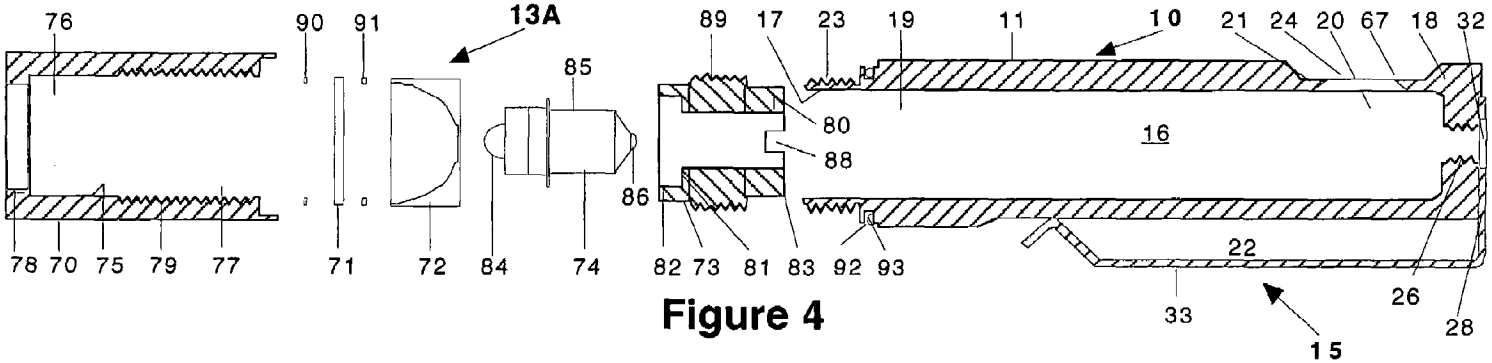
FIG. 4 is an exploded view in partial cross-section of the flashlight according to a first embodiment.
Figure 6:
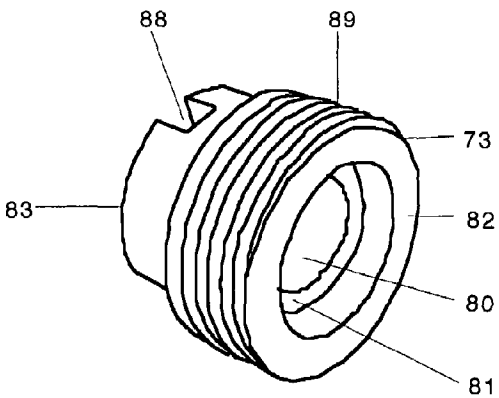
FIG. 6 is a perspective view illustrating a heat sink for the first embodiment of the flashlight head assembly.
Figure 5:
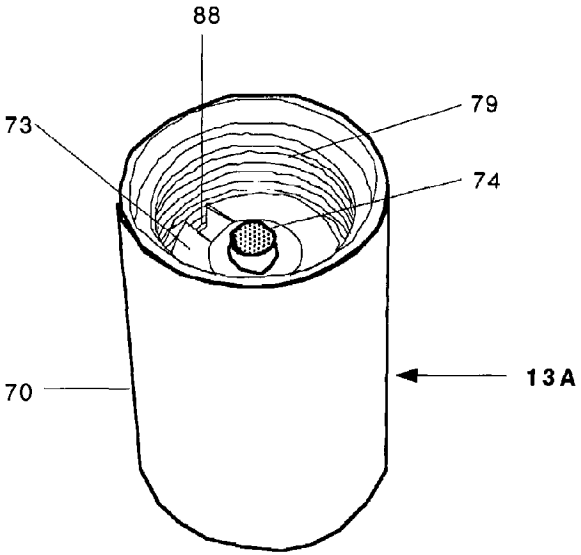
FIG. 5 is a perspective view illustrating the first embodiment of the flashlight head assembly for a flashlight according to either a first or second embodiment.
Figure 12:
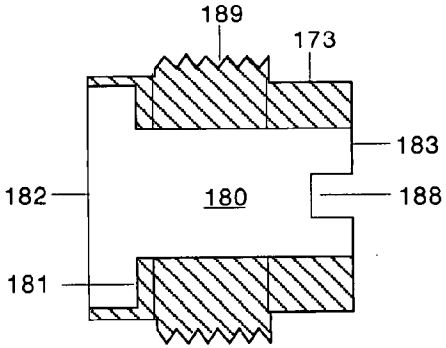
FIG. 12 is a cross-sectional view illustrating a heat sink for a second embodiment of the flashlight head assembly.
Figure 15:
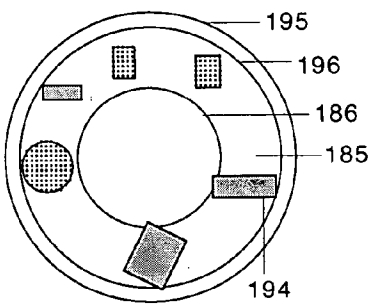
FIG. 15 is a rear view of the circuit for a second embodiment of the flashlight head assembly.
Figure 11:
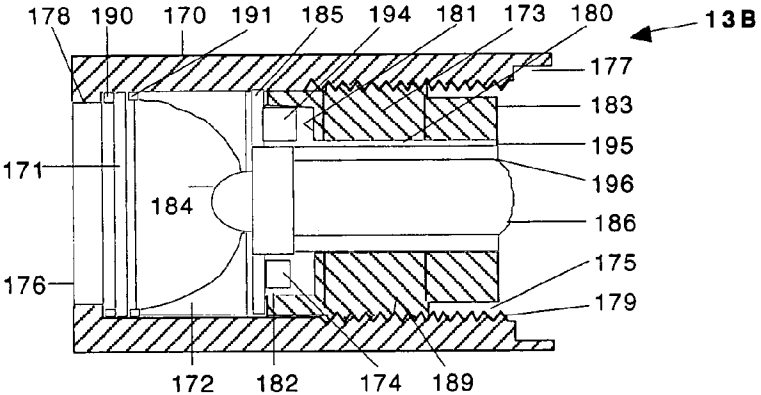
FIG. 11 is a cross-sectional view illustrating a second embodiment of a flashlight head assembly for a flashlight according to either a first or second embodiment.
Figure 14:
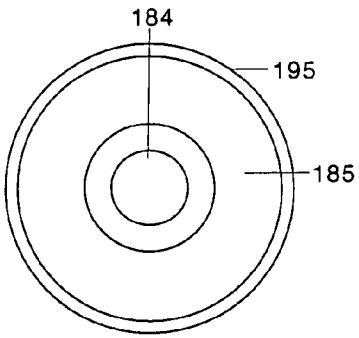
FIG. 14 is a front view of a circuit for a second embodiment of the flashlight head assembly.
Figure 13:
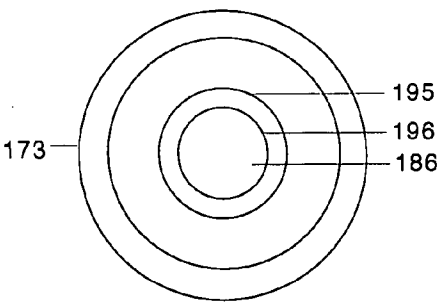
FIG. 13 is a rear view illustrating the heat sink for a second embodiment of the flashlight head assembly.
Figure 17:
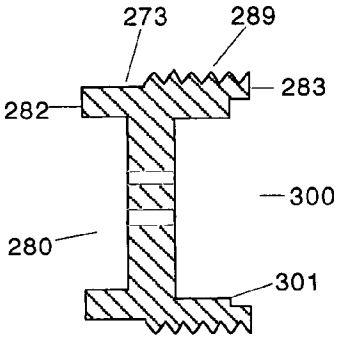
FIG. 17 is a cross-sectional view illustrating a heat sink for a third embodiment of the flashlight head assembly.
Figure 16:
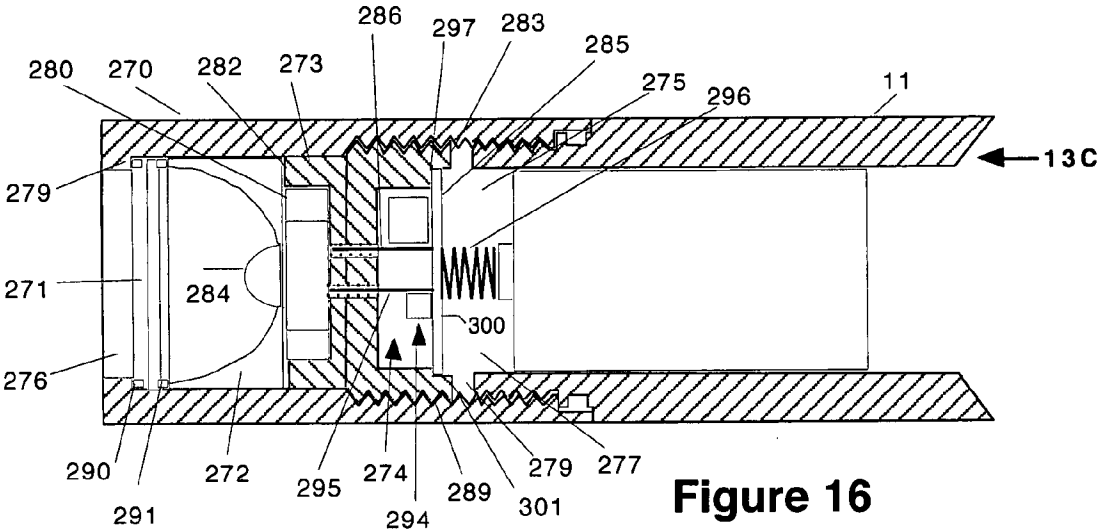
FIG. 16 is a cross-sectional view illustrating a third embodiment of a flashlight head assembly for a flashlight according to either a first or second embodiment.
Figure 19:
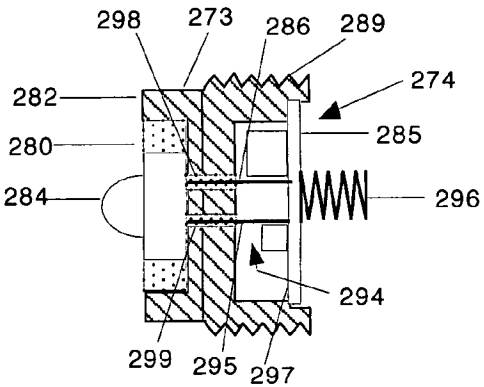
FIG. 19 is a cross-sectional view illustrating a heat sink and an LED assembly for a third embodiment of the flashlight head assembly.
Figure 18:
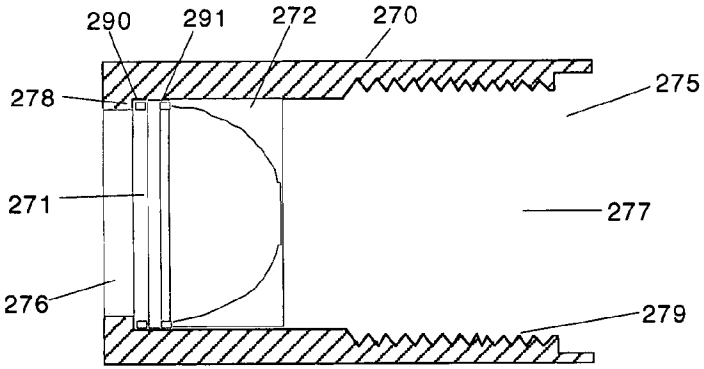
FIG. 18 is a cross-sectional view illustrating a flashlight head for a third embodiment of the flashlight head assembly.
Figure 21:
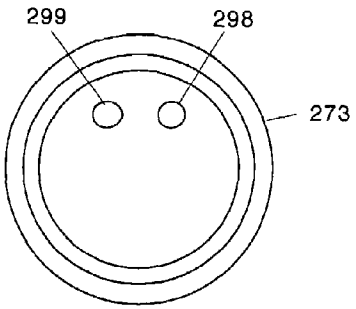
FIG. 21 is a front view illustrating a heat sink for a third embodiment of the flashlight head assembly.
Figure 23:
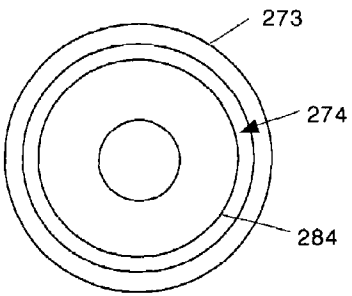
FIG. 23 is a front view illustrating an LED assembly and heat sink for a third embodiment of the flashlight head assembly.
Figure 20:
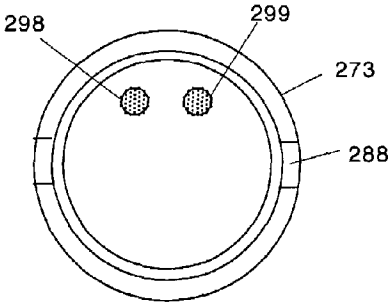
FIG. 20 is a rear view illustrating a heat sink for a third embodiment of the flashlight head assembly.
Figure 22:
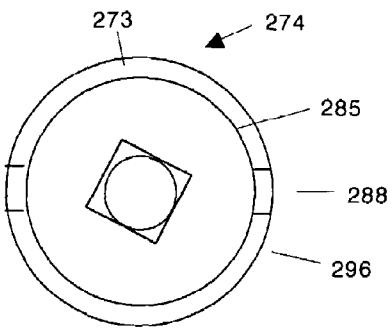
FIG. 22 is a rear view illustrating an LED assembly and a heat sink for a third embodiment of the flashlight head assembly.
Figure 25:
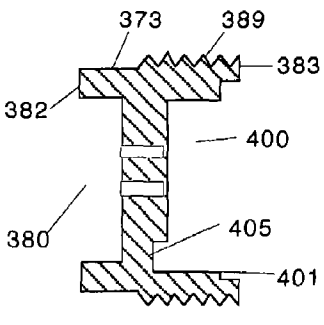
FIG. 25 is a cross-sectional view illustrating a heat sink for a fourth embodiment of the flashlight head assembly.
Figure 24:
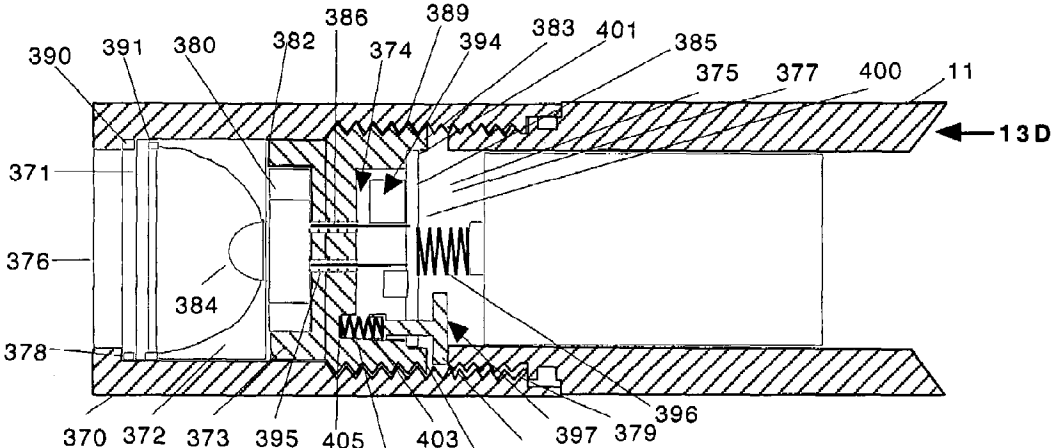
FIG. 24 is a cross-sectional view illustrating a fourth embodiment of a flashlight head assembly for a flashlight according to either a first or second embodiment.
Figure 28:
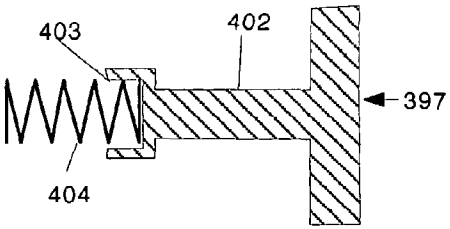
FIG. 28 is a cross-sectional view illustrating a ground connector of an LED assembly for a fourth embodiment of the flashlight head assembly.
Figure 27:
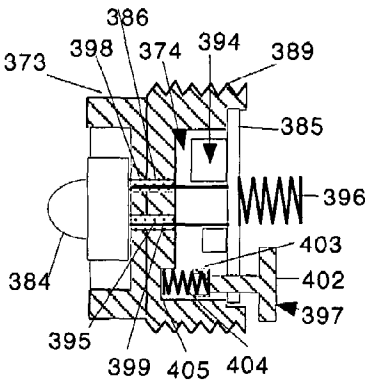
FIG. 27 is a cross-sectional view illustrating a heat sink and an LED assembly for a fourth embodiment of the flashlight head assembly.
Figure 26:
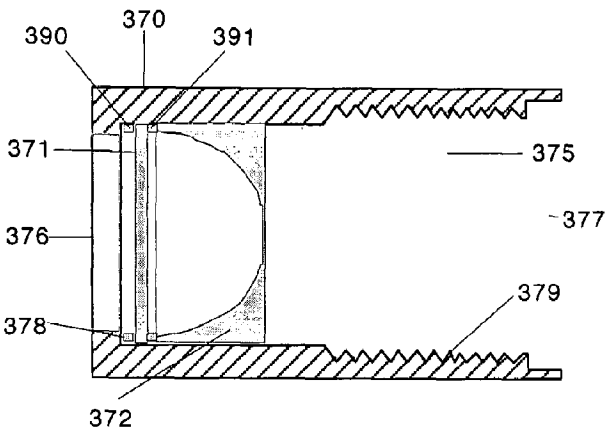
FIG. 26 is a cross-sectional view illustrating a flashlight head for a fourth embodiment of the flashlight head assembly.
Figure 30:
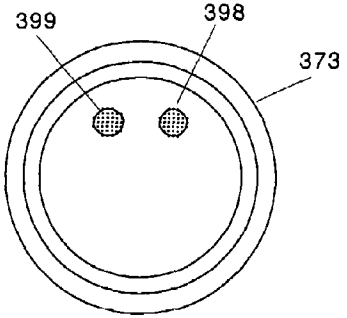
FIG. 30 is a front view illustrating a heat sink for a fourth embodiment of the flashlight head assembly.
Figure 32:
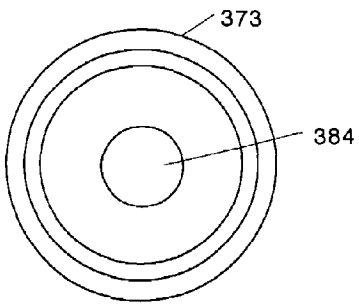
FIG. 32 is a front view illustrating an LED assembly and heat sink for a fourth embodiment of the flashlight head assembly.
Figure 29:
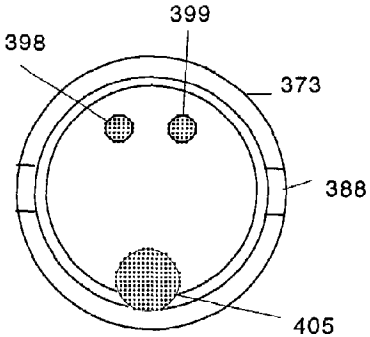
FIG. 29 is a rear view illustrating a heat sink for a fourth embodiment of the flashlight head assembly.
Figure 31:
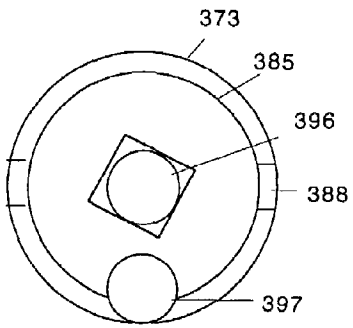
FIG. 31 is a rear view illustrating an LED assembly and a heat sink for a fourth embodiment of the flashlight head assembly.

Referring to FIGS. 1, 2, and 4, the body 11 includes a bore 16 that begins at a first open end 17 of the body 11 and ends at a second closed end 18 of the body 11. The bore 16 provides the body 11 with a battery compartment 19 and a switch assembly compartment 20. The battery compartment 19 in the first embodiment of the flashlight 10 is adapted to receive two batteries. While the flashlight 10 includes two batteries, those of ordinary skill in the art will recognize that the length of the body 11 may be increased to receive additional batteries. The first end 17 of the body 11 includes threads 23 that facilitate securing of the flashlight head assembly 13 onto the body 11 in a position aligned with the axis of the body 11. The first end 17 of the body 11 further includes a groove 92 that receives an o-ring 93 therein. The o-ring 93 provides a fluid tight seal between the body 11 and the flashlight head assembly 13. The body 11 further includes a base 21 and a switch aperture 24 at the base 21. The base 21 provides a planar surface on the body 11 for the switch assembly 12.

The hitch ball 14 furnishes the flashlight 10 with a striking implement at the second end 18 of the body 11, which, illustratively, may be employed to break an automobile window during an emergency situation. The second end 18 includes a threaded aperture 26 that receives the hitch ball 14 therein. The hitch ball 14 includes a threaded bolt portion 27 that engages the threaded aperture 26 to secure the hitch ball 14 to the body 11. The hitch ball 14 includes an aperture 25 therethrough that permits attachment of a lanyard to the flashlight 10.

While the threaded aperture 26 primarily functions to facilitate securing of the hitch ball 14 to the flashlight 10, those of ordinary skill in the art will recognize that other suitable objects may be secured to the flashlight 10. Illustratively as shown in FIG. 10, a baton 29 may be secured to the flashlight 10. The baton 29 includes a threaded bolt portion 30 that engages the threaded aperture 26 to secure the baton 29 to the body 11, thereby providing the flashlight 10 with a self-defense baton feature. The baton 29 may include a threaded aperture 31 that is engaged by the threaded bolt portion 27 of the hitch ball 14 to permit the securing of the hitch ball 14 to the baton 29. Still further, a firearm, such as a shotgun, including a threaded bolt portion would permit the securing of the flashlight 10 thereto.

The clip 15 permits securing of the flashlight 10 to any suitable object, such as for example, a belt, pants, a strap, a pocket, or the like. The clip 15 includes an angled portion 28 that allows the clip 15 to abut the second end 18 of the body 11 and a straight portion 33 that provides the securing means for the clip 15. The clip 15 further includes an aperture 32 along the angled portion 28. The aperture 32 aligns with the threaded aperture 26 at the second end 18, and the threaded bolt portion 27 of the hitch ball 14 passes through the aperture 32 such that the hitch ball 14 secures the clip 15 to the body 11 of the flashlight 10. The body 11 includes a flat 22 thereon for providing a planar surface that aids in the securing of the flashlight 10 to an object.

While the straight portion 33 of the clip 15 is primarily adapted for securing the flashlight 10 on or about a person, those of ordinary skill in the art will recognize that the clip 15 may be configured to secure the flashlight 10 to other suitable objects. Illustratively, a bracket-type section added to the clip 15 would permit securing of the flashlight 10 to a firearm.

The switch assembly 12 includes a switch cap 51, a switch housing 52, and a switch 53. The switch cap 51 includes a convex shape and is constructed from any suitable water resistant rubberized or plasticized material using well-known manufacturing techniques, such as vacuum forming or injection molding. The switch 53 is a push-button type switch of well-known design and is available from Switch Channel, P.O. Box 31557, Los Angeles, Calif. 90031.

The switch housing 52 is cylindrical in shape and has a diameter that permits frictional engagement with the inner walls of the switch assembly compartment 20. The switch housing 52 provides a support platform for the switch 53 and is constructed from any suitable water resistant plastics material using well-known manufacturing techniques, such as machining or injection molding. The switch housing 52 includes a cavity 54, contact apertures 55 and 56, and a groove 57 that receives therein an o-ring 58. The switch 53 seats within the cavity 54 of the switch housing 52 and is held in place using any suitable means such as friction or an adhesive. A terminal 59 fits through the contact aperture 55 and electrically connects via a conductive disc or soldering to a ground contact of the switch 53, thereby forming a ground terminal 63 for the switch assembly 12. Similarly, a terminal 60 fits through the contact aperture 56 and electrically connects via a conductive disc or soldering to a positive contact of the switch 53, thereby forming a positive terminal 64 for the switch assembly 12.

Once the switch 53 has been seated within and electrically connected to the switch housing 52, the switch housing 52 inserts into the switch assembly compartment 20 through the first open end 17 of the body 11. The switch housing 52 inserts into the switch assembly compartment 20 until the switch housing 52 abuts the second closed end 18 of the body 11. The abutment of the switch housing 52 with the second closed end 18 of the body 11 and the o-ring 58 provide a fluid tight seal at the second end 18 of the flashlight 10. Further, when the switch housing 52 abuts the second closed end 18 of the body 11, the switch housing 52 locates the switch 53 such that the switch 53 protrudes through the switch aperture 24 to permit activation of the switch 53 by a user of the flashlight 10. With the switch housing 52 properly located within the switch assembly compartment 20 and the switch 53 protruding through the switch aperture 24, the switch cap 51 fits over the switch 53 and the switch aperture 24 and is frictionally held in place by a lip 67 of the switch aperture 24 in order to provide the switch assembly with a fluid tight seal. In addition, the positive terminal 64 protrudes into the battery compartment 19 to engage batteries 65 and 66, and the ground terminal 63 engages the switch assembly compartment 20 to complete a circuit that powers the flashlight head assembly 13 upon the activation of the switch 53 by a user.

The switch assembly 12 is located at the cylindrical portion of the body 11 adjacent the second closed end 18 of the body 11 but not on the second closed end of the body 11 in order to permit grasping of the flashlight 10 with either an overhand grip as used by law enforcement or an underhand grip. In particular, the switch assembly 12 may be accessed by the thumb of a user from either an overhand grip or an underhand grip without the necessity of changing the position of the thumb relative to the switch assembly 12. Moreover, the base 21 on the cylindrical portion of the body 11 seats the thumb over the switch assembly 12. The location of the switch assembly 12 on the cylindrical portion of the body 11 accordingly improves over flashlights with switches located at the rear thereof, near the head thereof, or on the head thereof because such switch locations do not permit ease of use with both an overhand grip as used by law enforcement and an underhand grip.

Referring to FIGS. 2-8, a flashlight head assembly 13A according to a first embodiment includes a flashlight head 70, a lens 71, a reflector 72, a heat sink 73, and an LED assembly 74. The flashlight head 70 includes a bore 75 therethrough beginning at a first end 76 and ending at a second end 77. The flashlight head 70 at the first end 76 includes a lip 78 that provides a surface for retaining the lens 71 within the flashlight head 70. The flashlight head 70 at the second end 76 includes threads 79 internal thereto that maintain the heat sink 73 within the flashlight head 70 as well as facilitate the securing of the flashlight head assembly 13A onto the body 11.

The LED assembly 74 is available from LED Dynamics, Inc., whose business address is 44 Hull Street, Randolph, Vt 05060. The LED assembly 74 includes a housing 85, an LED 84, and an LED driver in the form of a micro-electronic circuit electrically coupled with the LED 84 to control the delivery of power thereto. The housing 85 provides a base for the LED 84. The housing further protects the micro-electronic circuit and is electrically coupled with the micro-electronic circuit to provide a ground terminal thereof. The housing 85 still further includes a terminal 86 electrically coupled with the micro-electronic circuit to provide an input terminal thereof. A flange 87 about the housing 85 facilitates seating of the LED assembly 74.

The heat sink 73, which is constructed from any suitable conductive material, such as aluminum, secures the LED assembly 74 within the flashlight head 70 and further delivers heat generated by the LED assembly 74 to the flashlight head 70 and the body 11. The heat sink 73 includes threads 89 on an exterior portion thereof that engage the threads 79 of the flashlight head 70 to secure the heat sink 73 within the flashlight head 70. The heat sink 73 includes a slot 88 that may be engaged by a tool such as a screwdriver to insert the heat sink 73 into the flashlight head 70. A bore 80 traverses the heat sink 73 beginning at a first end 82 and ending at a second end 83 to permit the insertion of the LED assembly 74 into the heat sink 73 such that the heat sink 73 substantially completely surrounds the LED assembly 74. The heat sink 73 is countersunk at the first end 82 to provide a seat 81 that positions the LED assembly 74 within the heat sink 73. In particular, the LED assembly 74 inserts into the heat sink 73 until the flange 87 of the housing 85 engages the seat 81 of the heat sink 73. While the heat sink 73 substantially completely surrounds the LED assembly 74, the heat sink 73 may be sized such that the LED 84 protrudes from the first end 82 of the heat sink 73 and the terminal 86 protrudes from the second end 83 of the heat sink 73. In addition to the contact between the flange 87 and the seat 81, the bore 80 includes a diameter that creates contact between the housing 85 of the LED assembly 74 and the heat sink 73. The heat sink 73 contacts the LED assembly 74 to facilitate the exchange of heat from the LED assembly 74 to the heat sink 73. The heat sink 73 further contacts the LED assembly 74 to electrically couple the heat sink 73 with the housing 85 of the LED assembly 74, thereby allowing the heat sink 73 to function as part of the ground terminal for the micro-electronic circuit of the LED assembly 74.

Construction of the flashlight head assembly 13A begins with the insertion of an o-ring 90 into the flashlight head 70 until the o-ring 90 abuts the lip 78 of the flashlight head 70. The lens 71 inserts into the flashlight head 70 until the lens 71 abuts the o-ring 90. An o-ring 91 then inserts into the flashlight head 70 until the o-ring 91 abuts the lens 71. After insertion of the o-ring 91, the reflector 72 inserts into the flashlight head 70 until the reflector 72 abuts the o-ring 91. The o-rings 90 and 91 create a fluid tight seal at the first end 76 of the flashlight head 70 and further protect from damage the edges of both the lens 71 and the reflector 72. The LED assembly 74 inserts within the heat sink 73 such that the heat sink 73 substantially completely surrounds the LED assembly 74. The heat sink 73 screws within the flashlight housing 70 until the first end 82 of the heat sink 73 abuts the reflector 72. In that position, the LED 84 of the LED assembly 74 protrudes into the reflector 72, which directs the light produced from the LED 84 through the lens 71 and from the flashlight head 70. Once construction of the flashlight head assembly 13A is completed, the flashlight head assembly 13A may be secured to the body 11 to produce the flashlight 10. Consequently, activation of the switch assembly 12 delivers power to the LED assembly 74 via the circuit encompassing the batteries of the flashlight 10, the LED assembly 74, the heat sink 73, the flashlight head 70, the body 11, and the switch assembly 12.

An advantage in the design of the flashlight head assembly 13A is that the heat sink 73 substantially completely surrounds the LED assembly 74. Substantially completely surrounding the LED assembly 74 maximizes surface area contact between the heat sink 73 and the LED assembly 74, thereby enhancing the exchange of heat from the LED assembly 74 to the heat sink 73. Substantially completely surrounding the LED assembly 74 further maximizes the mass of conductive material about the LED assembly 74, thereby enhancing the exchange of heat from the LED assembly 74 to the heat sink 73. A further advantage in the design of the flashlight head assembly 13A is that the heat sink 73 contacts the flashlight head 70, which essentially transforms the entire flashlight head assembly 13A into a heat sink for the LED assembly 74. Consequently, when the flashlight head assembly 13A is secured to the body 11, the body 11 acts as a heat sink to further enhance the dissipation of heat generated by the LED assembly 74. A still further advantage in the design of the flashlight head assembly 13A is that the heat sink 73 at the second end 83 contacts the body 11, thereby further enhancing the dissipation of heat generated by the LED assembly 74.

The reflector 72 may be constructed from a plastics material with a reflective coating that directs the light produced from the LED 84 through the lens 71 and from the flashlight head 70. The reflector 72 in the first embodiment is cylindrically shaped, which enhances the strength thereof. Cost considerations may be the driving factor in selecting a reflector constructed from a plastics material. Alternatively, the reflector 72 may be constructed from any suitable conductive material, such as aluminum, which is polished to provide a reflective surface that directs the light produced from the LED 84 through the lens 71 and from the flashlight head 70. The reflector 72 may be constructed from conductive material when it is desired to enhance the dissipation of heat generated by the LED assembly 74. Particularly, a reflector 72 constructed from conductive material abuts the heat sink 73, thereby increasing the mass of conductive material available to dissipate the heat generated by the LED assembly 74. The contact of a reflector 72 constructed from conductive material with the heat sink 73 effectively increases the size of the heat sink 73, thereby enhancing the ability of the heat sink 73 to reject heat generated by the LED assembly 74. Moreover, the reflector 72 is cylindrically shaped, which enhances the strength of thereof as well as increases the surface area available for the rejection of heat.

Referring to FIGS. 11-15, a flashlight head assembly 13B according to a second embodiment includes a flashlight head 170, a lens 171, a reflector 172, a heat sink 173, and an LED assembly 174. The flashlight head 170 includes a bore 175 therethrough beginning at a first end 176 and ending at a second end 177. The flashlight head 170 at the first end 176 includes a lip 178 that provides a surface for retaining the lens 171 within the flashlight head 170. The flashlight head 170 at the second end 176 includes threads 179 internal thereto that maintain the heat sink 173 within the flashlight head 170 as well as facilitate the securing of the flashlight head assembly 13B onto the body 11.

The LED assembly 174 is available from LED Dynamics, Inc., whose business address is 44 Hull Street, Randolph, Vt. 05060. The LED assembly 174 includes a printed circuit board 185, an LED 184 mounted onto the printed circuit board 185, and a micro-electronic circuit 194 mounted onto the printed circuit board 185 wherein the micro-electronic circuit 194 and the printed circuit board 185 form an LED driver for the LED 184. The micro-electronic circuit 194 is electrically coupled with the LED 184 to control the delivery of power thereto. The LED assembly 174 further includes a ground terminal 195 electrically coupled with the micro-electronic circuit 194 and an input terminal 186 also electrically coupled with the micro-electronic circuit 194. The LED assembly 174 may further include an insulator 196 that electrically isolates the ground terminal 195 from the input terminal 186. While the ground terminal 195 has been depicted as surrounding the input terminal 186, those of ordinary skill in the art will recognize that the ground terminal 195 and the input terminal 186 may be electrically coupled with the micro-electronic circuit 194 in any configuration suitable to facilitate the delivery of power thereto. Illustratively, the ground terminal 195 and the input terminal 186 may be two separate insulated leads.

The heat sink 173, which is constructed from any suitable conductive material, such as aluminum, secures the LED assembly 174 within the flashlight head 170 and further delivers heat generated by the LED assembly 174 to the flashlight head 170 and the body 11. The heat sink 173 includes threads 189 on an exterior portion thereof that engage the threads 179 of the flashlight head 170 to secure the heat sink 173 within the flashlight head 170. The heat sink 173 includes a slot 188 that may be engaged by a tool such as a screwdriver to insert the heat sink 173 into the flashlight head 170. A bore 180 traverses the heat sink 173 beginning at a first end 182 and ending at a second end 183 to permit the insertion of the LED assembly 174 into the heat sink 173 such that the heat sink 173 substantially completely surrounds the LED assembly 174. The heat sink 173 is countersunk at the first end 182 to provide a cavity 181 that receives the micro-electronic circuit 194 therein. In particular, the LED assembly 174 inserts into the heat sink 173 until the printed circuit board 185 engages the first end 182 of the heat sink 173 and the micro-electronic circuit 194 resides within cavity 181. While the heat sink 173 substantially completely surrounds the LED assembly 174, the heat sink 173 may be sized such that the lens of the LED 184 protrudes from the first end 182 of the heat sink 173 and the input terminal 186 protrudes from the second end 183 of the heat sink 173. In addition, the bore 180 includes a diameter that creates contact between the ground terminal 195 of the LED assembly 174 and the heat sink 173. The heat sink 173 contacts the LED assembly 174 to facilitate the exchange of heat from the LED assembly 174 to the heat sink 173. The heat sink 173 further contacts the LED assembly 174 to electrically couple the heat sink 173 with the ground terminal 195 of the LED assembly 174, thereby allowing the heat sink 173 to function as part of the ground terminal for the micro-electronic circuit 194 of the LED assembly 174. Alternatively, the input terminal 186 may be a separate insulated lead that protrudes from the second end 183 of the heat sink 173, and the ground terminal may also be a separate insulated lead that is electrically coupled to the heat sink 173 using any suitable means such as soldering.

Construction of the flashlight head assembly 13B begins with the insertion of an o-ring 190 into the flashlight head 170 until the o-ring 190 abuts the lip 178 of the flashlight head 170. The lens 171 inserts into the flashlight head 170 until the lens 171 abuts the o-ring 190. An o-ring 191 then inserts into the flashlight head 170 until the o-ring 191 abuts the lens 171. After insertion of the o-ring 191, the reflector 172 inserts into the flashlight head 170 until the reflector 172 abuts the o-ring 191. The o-rings 190 and 191 create a fluid tight seal at the first end 176 of the flashlight head 170 and further protect from damage the edges of both the lens 171 and the reflector 172. The LED assembly 174 inserts within the heat sink 173 such that the heat sink 173 substantially completely surrounds the LED assembly 174. Particularly, the LED assembly 174 inserts into the heat sink 173 until the printed circuit board 185 engages the first end 182 of the heat sink 173 and the micro-electronic circuit 194 resides within cavity 181. The heat sink 173 screws within the flashlight housing 170 until the printed circuit board 185 of the LED assembly 174 abuts the reflector 172. In that position, the lens of the LED 184 for the LED assembly 174 protrudes into the reflector 172, which directs the light produced from the LED 184 through the lens 171 and from the flashlight head 170. Once construction of the flashlight head assembly 13B is completed, the flashlight head assembly 13B may be secured to the body 11 to produce the flashlight 10. Consequently, activation of the switch assembly 12 delivers power to the LED assembly 174 via the circuit encompassing the batteries of the flashlight 10, the LED assembly 174, the heat sink 173, the flashlight head 170, the body 11, and the switch assembly 12.

An advantage in the design of the flashlight head assembly 13B is that the printed circuit board 185 engages the first end 182 of the heat sink 173 and the heat sink 173 substantially completely surrounds the micro-electronic circuit 194, the ground terminal 195, and the input terminal 186. Engaging the first end 182 of the heat sink 173 and substantially completely surrounding the LED assembly 174 maximizes surface area contact between the heat sink 173 and the LED assembly 174, thereby enhancing the exchange of heat from the LED assembly 174 to the heat sink 173. Engaging the first end 182 of the heat sink 173 and substantially completely surrounding the LED assembly 174 further maximizes the mass of conductive material about the LED assembly 174, thereby significantly enhancing the exchange of heat from the LED assembly 174 to the heat sink 173. A further advantage in the design of the flashlight head assembly 13B is that the heat sink 173 contacts the flashlight head 170, which essentially transforms the entire flashlight head assembly 13B into a heat sink for the LED assembly 174. Consequently, when the flashlight head assembly 13B is secured to the body 11, the body 11 acts as a heat sink to further enhance the dissipation of heat generated by the LED assembly 174. A still further advantage in the design of the flashlight head assembly 13B is that the heat sink 173 at the second end 183 contacts the body 11, thereby further enhancing the dissipation of heat generated by the LED assembly 174.

The reflector 172 may be constructed of a plastics material with a reflective coating that directs the light produced from the LED 184 through the lens 171 and from the flashlight head 170. The reflector 172 in the second embodiment is cylindrically shaped, which enhances the strength thereof. Cost considerations may be the driving factor in selecting a reflector constructed from a plastics material. Alternatively, the reflector 172 may be constructed from any suitable conductive material, such as aluminum, which is polished to provide a reflective surface that directs the light produced from the LED 184 through the lens 171 and from the flashlight head 170. The reflector 172 may be constructed from conductive material when it is desired to enhance the dissipation of heat generated by the LED assembly 174. Particularly, a reflector 172 constructed from conductive material abuts the printed circuit board 185 of the LED assembly 174, thereby rejecting heat generated on the printed circuit board 185 by the micro-electronic circuit 194. The contact of a reflector 172 constructed from conductive material with the printed circuit board 185 of the LED assembly 174 effectively adds an additional heat sink, thereby increasing the rejection of heat generated by the LED assembly 174. Moreover, the reflector 172 is cylindrically shaped, which enhances the strength of thereof as well as increases the surface area available for the rejection of heat.

Referring to FIGS. 16-23, a flashlight head assembly 13C according to a third embodiment includes a flashlight head 270, a lens 271, a reflector 272, a heat sink 273, and an LED assembly 274. The flashlight head 270 includes a bore 275 therethrough beginning at a first end 276 and ending at a second end 277. The flashlight head 270 at the first end 276 includes a lip 278 that provides a surface for retaining the lens 271 within the flashlight head 270. The flashlight head 270 at the second end 276 includes threads 279 internal thereto that maintain the heat sink 273 within the flashlight head 270 as well as facilitate the securing of the flashlight head assembly 13C onto the body 11.

The LED assembly 274 is available from LED Dynamics, Inc., whose business address is 44 Hull Street, Randolph, Vt.

05060. The LED assembly 274 includes a printed circuit board 285, an LED 284 electrically coupled with the printed circuit board 285 via an input lead 286 and a ground lead 295 of the LED 284, and a micro-electronic circuit 294 mounted onto the printed circuit board 285 wherein the micro-electronic circuit 294 and the printed circuit board 285 form an LED driver for the LED 284. The micro-electronic circuit 294 is electrically coupled with the LED 284 through the printed circuit board 285 to control the delivery of power to the LED 284. The LED assembly 274 further includes an input terminal 296 electrically coupled with the micro-electronic circuit 294 via the printed circuit board 285. The LED assembly 274 still further includes a ground terminal 297 electrically coupled with the micro-electronic circuit 294 via the printed circuit board 285. The ground terminal 297 in the third embodiment traverses the entire edge of the printed circuit board 285 in order to provide a surface area sufficient for the proper grounding of the LED assembly 274.

The heat sink 273, which is constructed from any suitable conductive material, such as aluminum, secures the LED assembly 274 within the flashlight head 270 and further delivers heat generated by the LED assembly 274 to the flashlight head 270 and the body 11. The heat sink 273 includes threads 289 on an exterior portion thereof that engage the threads 279 of the flashlight head 270 to secure the heat sink 273 within the flashlight head 270. The heat sink 273 includes a slot 288 that may be engaged by a tool such as a screwdriver to insert the heat sink 273 into the flashlight head 270. A first cavity 280 at a first end 282 of the heat sink 273 provides a space for the mounting of the LED 284 to the heat sink 273. Similarly, a second cavity 300 at a second end 283 of the heat sink 273 provides a space for the mounting of the printed circuit board 285 within the heat sink 273. A first aperture 298 and a second aperture 299 pass from the first cavity 280 to the second cavity 300 to permit a respective one of the input lead 286 and the ground lead 295 of the LED 284 to extend into the second cavity 300. The heat sink 273 is countersunk at the second end 283 thereby creating a detent 301 that seats the printed circuit board 285 within the heat sink 273 and further electrically connects the ground terminal 297 with the heat sink 273.

The LED assembly 274 in the third embodiment is built into the heat sink 273, which enhances the ability of the heat sink 273 to dissipate heat generated by the LED assembly 274. In particular, the LED 284 fits within the first cavity 280 such that only the lens portion of the LED 284 extends above the first end 282 of the heat sink 273. Furthermore, the input lead 286 passes through the first aperture 298 and extends into the second cavity 300. Likewise, the ground lead 295 passes through the second aperture 299 and extends into the second cavity 300. After placement of the LED 284 within the first cavity 280, an adhesive substance such as epoxy is applied about the LED 284 to secure the LED 284 within the first cavity 280. Once the LED 284 is secured within the first cavity 280, the input lead 286 and the ground lead 295 are connected to the printed circuit board 285 and thus the micro-electronic circuit 294 using any suitable means, such as soldering. The printed circuit board 285 with the micro-electronic circuit 294 facing the second cavity 300 is then inserted into the second cavity 300 until the edge on the printed circuit board 285 abuts the detent 301. The abutment of the printed circuit board 285 with the detent 301 creates an electrical connection between the LED assembly 274 and the heat sink 273 because the ground terminal 297 traverses the entire edge of the printed circuit board 285 and thus engages the detent 301. The heat sink 273 accordingly functions as part of the ground terminal for the micro-electronic circuit 294.

Construction of the flashlight head assembly 13C begins with the insertion of an o-ring 290 into the flashlight head 270 until the o-ring 290 abuts the lip 278 of the flashlight head 270. The lens 271 inserts into the flashlight head 270 until the lens 271 abuts the o-ring 290. An o-ring 291 then inserts into the flashlight head 270 until the o-ring 291 abuts the lens 271. After insertion of the o-ring 291, the reflector 272 inserts into the flashlight head 270 until the reflector 272 abuts the o-ring 291. The o-rings 290 and 291 create a fluid tight seal at the first end 276 of the flashlight head 270 and further protect from damage the edges of both the lens 271 and the reflector 272. The heat sink 273, which includes the LED assembly 274 built therein as previously described, screws within the flashlight housing 270 until the first end 282 of the heat sink 273 abuts the reflector 272. In that position, the lens of the LED 284 protrudes into the reflector 272, which directs the light produced from the LED 284 through the lens 271 and from the flashlight head 270. Once construction of the flashlight head assembly 13C is completed, the flashlight head assembly 13C may be secured to the body 11 to produce the flashlight 10. Consequently, activation of the switch assembly 12 delivers power to the LED assembly 274 via a circuit encompassing the batteries of the flashlight 10, the input terminal 296, the micro-electronic circuit 294, the LED 284, the ground terminal 297, the heat sink 273, the flashlight head 270, the body 11, and the switch assembly 12.

An advantage in the design of the flashlight head assembly 13C is that the LED assembly 274 is built within the heat sink 273 such that the heat sink 273 substantially completely surrounds the LED 284, the printed circuit board 285, and the micro-electronic circuit 294. In particular, substantially completely surrounding the LED assembly 274 with the heat sink 273 maximizes surface area contact between the heat sink 273 and the LED assembly 274, thereby enhancing the exchange of heat from the LED assembly 274 to the heat sink 273. Further, substantially completely surrounding the LED assembly 274 with the heat sink 273 maximizes the mass of conductive material about the LED assembly 274, thereby enhancing the exchange of heat from the LED assembly 274 to the heat sink 273. A further advantage in the design of the flashlight head assembly 13C is that the heat sink 273 contacts the flashlight head 270, which essentially transforms the entire flashlight head assembly 13C into a heat sink for the LED assembly 274. Consequently, when the flashlight head assembly 13C is secured to the body 11, the body 11 acts as a heat sink to further enhance the dissipation of heat generated by the LED assembly 274.

The reflector 272 may be constructed of a plastics material with a reflective coating that directs the light produced from the LED 284 through the lens 271 and from the flashlight head 270. The reflector 272 in the third embodiment is cylindrically shaped, which enhances the strength thereof. Cost considerations may be the driving factor in selecting a reflector constructed from a plastics material. Alternatively, the reflector 272 may be constructed from any suitable conductive material, such as aluminum, which is polished to provide a reflective surface that directs the light produced from the LED 284 through the lens 271 and from the flashlight head 270. The reflector 272 may be constructed from conductive material when it is desired to enhance the dissipation of heat generated by the LED assembly 274. Particularly, a reflector 272 constructed from conductive material abuts the printed circuit board 285 of the LED assembly 274, thereby rejecting heat generated on the printed circuit board 285 by the micro-electronic circuit 294. The contact of a reflector 272 constructed from conductive material with the printed circuit board 285 of the LED assembly 274 effectively adds an additional heat sink, thereby increasing the rejection of heat generated by the LED assembly 274. Moreover, the reflector 272 is cylindrically shaped, which enhances the strength of thereof as well as increases the surface area available for the rejection of heat.

Referring to FIGS. 24-32, a flashlight head assembly 13D according to a fourth embodiment includes a flashlight head 370, a lens 371, a reflector 372, a heat sink 373, and an LED assembly 374. The flashlight head 370 includes a bore 375 therethrough beginning at a first end 376 and ending at a second end 377. The flashlight head 370 at the first end 376 includes a lip 378 that provides a surface for retaining the lens 371 within the flashlight head 370. The flashlight head 370 at the second end 376 includes threads 379 internal thereto that maintain the heat sink 373 within the flashlight head 370 as well as facilitate the securing of the flashlight head assembly 13D onto the body 11.

The LED assembly 374 is available from LED Dynamics, Inc., whose business address is 44 Hull Street, Randolph, Vt. 05060. The LED assembly 374 includes a printed circuit board 385, an LED 384 electrically coupled with the printed circuit board 385 via an input lead 386 and a ground lead 395 of the LED 384, and a micro-electronic circuit 394 mounted onto the printed circuit board 385 wherein the micro-electronic circuit 394 and the printed circuit board 385 form an LED driver for the LED 384. The micro-electronic circuit 394 is electrically coupled with the LED 384 through the printed circuit board 385 to control the delivery of power to the LED 384. The LED assembly 374 further includes an input terminal 396 electrically coupled with the micro-electronic circuit 394 via the printed circuit board 385. The LED assembly 374 still further includes a ground connector 397 that contacts a trace on the printed circuit board 385 thereby electrically coupling with the micro-electronic circuit 394. In the fourth embodiment, the ground connector 397 includes a ground pin 402 with a cavity 403 that receives therein a biasing member 404, such as a spring.

The heat sink 373, which is constructed from any suitable conductive material, such as aluminum, secures the LED assembly 374 within the flashlight head 370 and further delivers heat generated by the LED assembly 374 to the flashlight head 370 and the body 11. The heat sink 373 includes threads 389 on an exterior portion thereof that engage the threads 379 of the flashlight head 370 to secure the heat sink 373 within the flashlight head 370. The heat sink 373 includes a slot 388 that may be engaged by a tool such as a screwdriver to insert the heat sink 373 into the flashlight head 370. A first cavity 380 at a first end 382 of the heat sink 373 provides a space for the mounting of the LED 384 to the heat sink 373. Similarly, a second cavity 400 at a second end 383 of the heat sink 373 provides a space for the mounting of the printed circuit board 385 within the heat sink 373. A first aperture 398 and a second aperture 399 pass from the first cavity 380 to the second cavity 400 to permit a respective one of the input lead 386 and the ground lead 395 of the LED 384 to extend into the second cavity 400. The heat sink 373 is countersunk at the second end 383 thereby creating a detent 401 that seats the printed circuit board 385 within the heat sink 373. The heat sink 373 further includes a pocket 405 that receives the biasing member 404 of the ground connector 397 therein.

The LED assembly 374 in the fourth embodiment is built into the heat sink 373, which enhances the ability of the heat sink 373 to dissipate heat generated by the LED assembly 374. In particular, the LED 384 fits within the first cavity 380 such that only the lens portion of the LED 384 extends above the first end 382 of the heat sink 374. Furthermore, the input lead 386 passes through the first aperture 398 and extends into the second cavity 400. Likewise, the ground lead 395 passes through the second aperture 399 and extends into the second cavity 400. After placement of the LED 384 within the first cavity 380, an adhesive substance such as epoxy is applied about the LED 384 to secure the LED 384 within the first cavity 380. Once the LED 384 is secured within the first cavity 380, the input lead 386 and the ground lead 395 are connected to the printed circuit board 385 and thus the micro-electronic circuit 394 using any suitable means, such as soldering. The printed circuit board 385 with the micro-electronic circuit 394 facing the second cavity 400 is then inserted into the second cavity 400 until the edge on the printed circuit board 385 abuts the detent 401. The abutment of the printed circuit board 385 with the detent 301 extends the ground pin 402 such that the ground pin 402 engages the body 11 of the flashlight 10, thereby providing a ground connection from the LED assembly 374 to the body 11.

Construction of the flashlight head assembly 13D begins with the insertion of an o-ring 390 into the flashlight head 370 until the o-ring 390 abuts the lip 378 of the flashlight head 370. The lens 371 inserts into the flashlight head 370 until the lens 371 abuts the o-ring 390. An o-ring 391 then inserts into the flashlight head 370 until the o-ring 391 abuts the lens 371. After insertion of the o-ring 391, the reflector 372 inserts into the flashlight head 370 until the reflector 372 abuts the o-ring 391. The o-rings 390 and 391 create a fluid tight seal at the first end 376 of the flashlight head 370 and further protect from damage the edges of both the lens 371 and the reflector 372. The heat sink 373, which includes the LED assembly 374 built therein as previously described, screws within the flashlight housing 370 until the first end 382 of the heat sink 373 abuts the reflector 372. In that position, the lens of the LED 384 protrudes into the reflector 372, which directs the light produced from the LED 384 through the lens 371 and from the flashlight head 370. Once construction of the flashlight head assembly 13D is completed, the flashlight head assembly 13D may be secured to the body 11 to produce the flashlight 10. Consequently, activation of the switch assembly 12 delivers power to the LED assembly 374 via a circuit encompassing the batteries of the flashlight 10, the input terminal 396, the micro-electronic circuit 394, the LED 384, the ground connector 397, the body 11, and the switch assembly 12.

An advantage in the design of the flashlight head assembly 13D is that the LED assembly 374 is built within the heat sink 373 such that the heat sink 373 substantially completely surrounds the LED 384, the printed circuit board 385, and the micro-electronic circuit 394. In particular, substantially completely surrounding the LED assembly 374 with the heat sink 373 maximizes surface area contact between the heat sink 373 and the LED assembly 374, thereby enhancing the exchange of heat from the LED assembly 374 to the heat sink 373. Further, substantially completely surrounding the LED assembly 374 with the heat sink 373 maximizes the mass of conductive material about the LED assembly 374, thereby enhancing the exchange of heat from the LED assembly 374 to the heat sink 373. A further advantage in the design of the flashlight head assembly 13D is that the heat sink 373 contacts the flashlight head 370, which essentially transforms the entire flashlight head assembly 13D into a heat sink for the LED assembly 374. Consequently, when the flashlight head assembly 13D is secured to the body 11, the body 11 acts as a heat sink to further enhance the dissipation of heat generated by the LED assembly 374.

The reflector 372 may be constructed of a plastics material with a reflective coating that directs the light produced from the LED 384 through the lens 371 and from the flashlight head 370. The reflector 372 in the fourth embodiment is cylindrically shaped, which enhances the strength thereof. Cost considerations may be the driving factor in selecting a reflector constructed from a plastics material. Alternatively, the reflector 372 may be constructed from any suitable conductive material, such as aluminum, which is polished to provide a reflective surface that directs the light produced from the LED 384 through the lens 371 and from the flashlight head 370. The reflector 372 may be constructed from conductive material when it is desired to enhance the dissipation of heat generated by the LED assembly 374. Particularly, a reflector 372 constructed from conductive material abuts the printed circuit board 385 of the LED assembly 374, thereby rejecting heat generated on the printed circuit board 385 by the micro-electronic circuit 394. The contact of a reflector 372 constructed from conductive material with the printed circuit board 385 of the LED assembly 374 effectively adds an additional heat sink, thereby increasing the rejection of heat generated by the LED assembly 374. Moreover, the reflector 372 is cylindrically shaped, which enhances the strength of thereof as well as increases the surface area available for the rejection of heat.

FIG. 9 illustrates a flashlight 100 according to a second embodiment. The flashlight 100 includes a switch assembly, which may be the switch assembly 12 previously described with reference to the flashlight 10. The flashlight 100 further includes a flashlight head assembly, which may be the previously described flashlight head assemblies 13A-13D. The flashlight 100 still further includes a hitch ball, which may be the hitch ball 14 previously described with reference to the flashlight 10, and a clip, which may be the clip 15 previously described with reference to the flashlight 10.

Referring to FIG. 9, the flashlight 100 according to a second embodiment includes a body 111. The body 111 includes a bore 116 that begins at a first open end 117 of the body 111 and ends at a second closed end 118 of the body 111. The bore 116 provides the body 111 with a battery compartment 119 and a switch assembly compartment 120. The battery compartment 119 in the second embodiment of the flashlight 100 is adapted for one battery. While the flashlight 100 includes one battery, those of ordinary skill in the art will recognize that the length of the body 111 may be increased to receive additional batteries. The first end 117 of the body 111 includes threads 123 that facilitate securing of one of the flashlight head assemblies 13A-13D onto the body 111 in a position aligned with the axis of the body 111. The first end 117 of the body 111 further includes a groove 112 that receives an o-ring 113 therein. The o-ring 113 provides a fluid tight seal between the body 111 and one of the flashlight head assemblies 13A-13D. The body 111 further includes a base 121 and a switch aperture 124 at the base 121. The base 121 provides a planar surface on the body 111 for a switch assembly, such as the switch assembly 12.

Accordingly, a switch assembly inserts into the body 111, and one of the flashlight head assemblies 13A-13D secures onto the body 111 to produce the flashlight 10. Furthermore, a clip may be placed at the second closed end 118 of the body 111, and a hitch ball inserted into a threaded aperture 126 of the body 111 to secure the clip to the body 111 and provide the flashlight 100 with a hitch ball. Alternatively, a baton 29 may be inserted into the threaded aperture 126 of the body 111. Activation of the switch assembly thus delivers power to an LED assembly of one of the flashlight head assemblies 13A-13C via a circuit encompassing the battery of the flashlight 100, the LED assembly, the heat sink, the flashlight head for one of the flashlight head assemblies 13A-13C, the body 111, and the switch assembly. Alternatively, activation of the switch assembly thus delivers power to an LED assembly of the flashlight head assembly 13D via a circuit encompassing the battery of the flashlight 100, the LED assembly, the ground connector, the body 111; and the switch assembly.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description; rather, it is defined only by the claims that follow.

I claim:

1. A flashlight, comprising:

a body;

a flashlight head assembly, comprising:

a flashlight head including a first end and a second end securable to the body, a lens disposed in the flashlight head at the first end, a reflector disposed in the flashlight head adjacent the lens, a heat sink disposed in the flashlight head adjacent the reflector, and an LED assembly comprising an LED electrically connected with an LED driver, wherein the LED and the LED driver are disposed within the heat sink, and further wherein the heat sink substantially completely surrounds the LED and the LED driver; and a switch assembly disposed in the body, wherein the switch assembly electrically connects with the LED assembly to regulate the delivery of power to the LED assembly.

2. The flashlight according to claim 1, wherein substantially completely surrounding the LED and the LED driver with the heat sink maximizes the surface area contact between the heat sink and the LED assembly.

3. The flashlight according to claim 1, wherein substantially completely surrounding the LED and the LED driver with the heat sink maximizes the mass of conductive material about the LED assembly.

4. The flashlight according to claim 1, wherein the heat sink engages the flashlight head such that the flashlight head assembly functions as a heat sink for the LED and the LED driver.

5. The flashlight according to claim 4, wherein the flashlight head assembly engages the body such that the flashlight functions as a heat sink for the LED and the LED driver.

6. The flashlight according to claim 1, wherein:

the LED is disposed within a first end of the heat sink; and the LED driver is disposed within a second end of the heat sink.

7. The flashlight according to claim 6, wherein the LED driver comprises:

a printed circuit board disposed within the second end of the heat sink, wherein the LED electrically connects with the printed circuit board; and a micro-electronic circuit disposed on the printed circuit board, wherein the micro-electronic circuit controls the delivery of power to the LED.

8. The flashlight according to claim 7, wherein the LED assembly, further comprises:

an input terminal electrically connected with the printed circuit board; and a ground terminal electrically connected with the printed circuit board, wherein the ground terminal engages the heat sink such that the heat sink electrically connects with the LED assembly.

9. The flashlight according to claim 8, wherein the heat sink, the flashlight head, and the body electrically connect the LED assembly with the switch assembly.

10. The flashlight according to claim 7, wherein locating the LED at the first end of the heat sink and the printed circuit board at the second end of the heat sink thermally isolates the micro-electronic circuit from the LED.

11. The flashlight according to claim 7, wherein the LED assembly, further comprises:

an input terminal electrically connected with the printed circuit board; and a ground connector electrically connected with the printed circuit board, wherein the ground connector engages the body thereby electrically connecting the LED assembly with the switch assembly.

12. The flashlight according to claim 1, wherein locating the heat sink adjacent to the reflector extends a lens of the LED into the reflector.

13. The flashlight according to claim 1, wherein the LED driver, comprises:

a printed circuit board disposed within the heat sink, wherein the LED electrically connects with the printed circuit board; and a micro-electronic circuit disposed on the printed circuit board, wherein the micro-electronic circuit controls the delivery of power to the LED.

14. The flashlight according to claim 13, wherein the LED assembly, further comprises:

an input terminal electrically connected with the printed circuit board; and a ground terminal electrically connected with the printed circuit board, wherein the ground terminal engages the heat sink such that the heat sink electrically connects with the LED assembly.

15. The flashlight according to claim 14, wherein the heat sink, the flashlight head, and the body electrically connect the LED assembly with the switch assembly.

16. The flashlight according to claim 13, wherein the LED mounts on the printed circuit board.

17. The flashlight according to claim 1, wherein the LED assembly, further comprises a housing disposed within the heat sink, wherein the LED and LED driver are disposed within the housing.

18. The flashlight according to claim 17, wherein the LED driver comprises a micro-electronic circuit that controls the delivery of power to the LED.

19. The flashlight according to claim 18, wherein the housing includes an input terminal electrically connected with the micro-electronic circuit.

20. The flashlight according to claim 19, wherein the housing electrically connects with the micro-electronic circuit, wherein, when the housing engages the heat sink, the heat sink electrically connects with the LED assembly.

21. The flashlight according to claim 20, wherein the heat sink, the flashlight head, and the body electrically connect the LED assembly with the switch assembly.

22. The flashlight according to claim 1, wherein the reflector comprises a thermally conductive material such that, when the heat sink engages the reflector, the reflector functions as a heat sink for the LED assembly.

23. The flashlight according to claim 1, wherein the body comprises:

a first end securable to the flashlight head assembly;

a second end; and a substantially cylindrical portion between the first end and the second end.

24. The flashlight according to claim 23, wherein the switch assembly is located at the substantially cylindrical portion of the body adjacent the second end.

25. The flashlight according to claim 23, wherein the body further comprises a switch aperture located on the substantially cylindrical portion of the body adjacent the second end.

26. The flashlight according to claim 25, wherein the switch assembly, comprises:

a switch housing disposed within the body at the second end;

a switch mounted to the switch housing, wherein the switch protrudes through the switch aperture; and a switch cap secured to the body over the switch aperture.

27. The flashlight according to claim 23, further comprising:

a clip disposed at the second end of the body; and a hitch ball securable to the second end of the body such that the hitch ball fastens the clip to the body.

28. The flashlight according to claim 23, further comprising a baton securable to the second end of the body.

29. A flashlight, comprising:

a body, comprising:

a first end, a second end, a substantially cylindrical portion between the first end and the second end, and a switch aperture located on the substantially cylindrical portion of the body adjacent the second end;

a flashlight head assembly securable to the first end of the body; and a switch assembly electrically connected with the flashlight head assembly, wherein the switch assembly is located at the substantially cylindrical portion of the body adjacent the second end, and further wherein the switch assembly comprises a switch that protrudes through the switch aperture such that activation of the switch regulates the delivery of power to the flashlight head assembly.

30. The flashlight according to claim 29, wherein the switch assembly, comprises:

a switch housing disposed within the substantially cylindrical portion of the body adjacent the second end, wherein the switch mounts to the switch housing and protrudes through the switch aperture; and a switch cap secured to the body over the switch aperture.

31. A flashlight, comprising:

a body, comprising:

a first end, a second end, and a substantially cylindrical portion between the first end and the second end;

a flashlight head assembly securable to the first end of the body;

a switch assembly disposed within the body, wherein the switch assembly electrically connects with the flashlight head assembly to regulate the delivery of power to the flashlight head assembly;

a clip disposed at the second end of the body; and a hitch ball securable to the second end of the body such that the hitch ball fastens the clip to the body.

* * * * *